US008307911B2

(12) United States Patent
Chu et al.

(10) Patent No.: US 8,307,911 B2
(45) Date of Patent: Nov. 13, 2012

(54) TORQUE SYSTEM OF POWER TOOL

(75) Inventors: Chiou Long Chu, Miaoli (TW); Jung Kwan Kuo, Miaoli (TW); Yen Shan Fang, Miaoli (TW); Chin-Chiang Chen, Miaoli (TW); Ching-Hsu Wu, Miaoli (TW)

(73) Assignee: Porite Taiwan Co., Ltd., Ta Pu Li Chunan, Miaoli (TW)

( * ) Notice: Subject to any disclaimer, the term of this patent is extended or adjusted under 35 U.S.C. 154(b) by 381 days.

(21) Appl. No.: 12/657,844

(22) Filed: Jan. 28, 2010

(65) Prior Publication Data

US 2011/0180288 A1 Jul. 28, 2011

(51) Int. Cl.
*B25B 21/00* (2006.01)

(52) U.S. Cl. ..... 173/47; 173/5; 173/178; 192/223

(58) Field of Classification Search ..... 173/5, 178, 173/47, 48, 93.5; 192/223
See application file for complete search history.

(56) References Cited

U.S. PATENT DOCUMENTS 6,857,983 B2 * 2/2005 Milbourne et al. ..... 475/269
7,455,574 B2 * 11/2008 Chu et al. ..... 451/342

* cited by examiner

*Primary Examiner* — Lindsay Low
*Assistant Examiner* — Andrew M Tecco
(74) *Attorney, Agent, or Firm* — Charles E. Baxley

(57) ABSTRACT

A torque system of a power tool includes a combination of a first body and a second body, in which a toothed ring is assembled; and a mode selecting assembly, a torque adjusting module and control pins disposed on the second body. The torque system further includes restricting mechanisms formed on the second body, and the control pins are respectively disposed in the restricting mechanisms. One side of the control pin has a stopper block, and the restricting mechanism includes a first stopper, a second stopper and a through hole. When the control pin is driven to rotate and the stopper block faces the first stopper or the through hole, the object of switching each operation mode is achieved.

16 Claims, 11 Drawing Sheets

TORQUE SYSTEM OF POWER TOOL

BACKGROUND OF THE INVENTION

1. Field of the Invention

The invention relates in general to a torque system, and more particularly to a torque output system, applied to a spindle of a power tool, for providing different torque for different operation modes.

2. Description of the Related Art

Generally speaking, the power tool can provide usage modes including a screw mode, a drill mode and a hammer mode. In the screw mode, the spindle is released (or jumps) after the output torque of the spindle reaches a predetermined torque value so that the spindle cannot further output the torque. In the drill mode and the hammer mode, the spindle is locked and cannot be released. So, the spindle can continuously output the torque transmitted from the power source (motor). The spindle of the power tool may mesh with a planetary gear system, which is composed of a transmission gear, a plurality of planet gears, a planet gear seat and a toothed ring. The above-mentioned gear system may be adopted to drive the spindle.

In detail, an end portion of the toothed ring corresponds to a control device. The control device includes a plurality of control assemblies, an adjusting washer and a plurality of movable pins. The control assembly includes a combination of a steel ball and a fixing pin. The movable pins are embedded onto the adjusting washer, and the adjusting washer is disposed at one end of each fixing pin.

In the screw mode, the fixing pin faces the movable pin. When the spindle is released or jumps, the steel ball and the fixing pin are pushed by the toothed ring to move (jump), and the fixing pin simultaneously pushes the movable pin. Rotating the adjusting ring of the power tool can switch the working mode from the screw mode to the drill mode or the hammer mode. During the mode switching, the adjusting washer is rotated and the movable pin is shifted so that the fixing pin faces the surface of the adjusting washer, and the fixing pin cannot shift (jump). Thus, the toothed ring cannot drive the combination of the steel ball and the fixing pin. Therefore, the spindle continuously outputs the torque transmitted from the power source.

In the torque system of the power tool mentioned hereinabove, multiple independent steel balls and fixing pins have to be provided. Thus, the material cost is high, and the assembling processes become inconvenient.

SUMMARY OF THE INVENTION

A main objective of the invention is to provide a torque system of a power tool, wherein the torque system has a simplified structure so that the material cost can be lowered, and the torque system may be assembled more simply.

Another objective of the invention is to provide a torque system of a power tool, wherein the torque system can enhance the precision of operation, and make the operation become more laborsaving.

The invention achieves the above-identified objectives by providing a torque system of a power tool, in which multiple control pins are respectively disposed in multiple restricting mechanisms. Each control pin has a stopper block, and each restricting mechanism has a first stopper and a second stopper disposed on different planes.

When the stopper block of the control pin corresponds to the first stopper, the control pin may be shifted so that the screw mode may be entered. When the control pin corresponds to the second stopper, the control pin cannot be shifted so that the drill mode or the hammer mode may be entered.

Further benefits and advantages of the present invention will become apparent after a careful reading of the detailed description with appropriate reference to the accompanying drawings.

BRIEF DESCRIPTION OF THE DRAWINGS

The above and other objects of the present invention will become readily apparent by reference to the following detailed description when considered in conjunction with the accompanying drawings wherein.

DETAILED DESCRIPTION OF THE INVENTION

Figure 1:
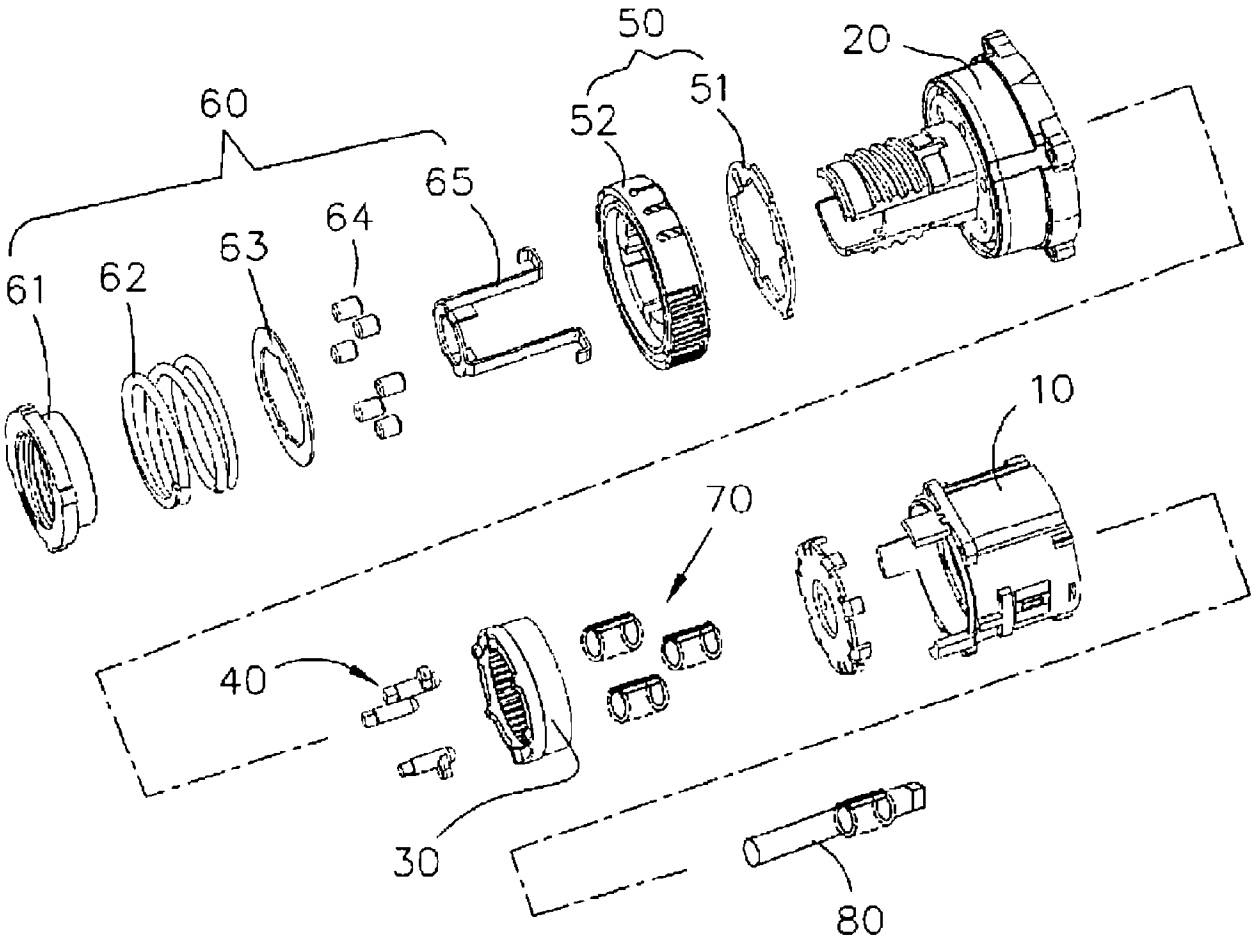
FIG. 1 is an exploded view showing the invention.

As shown in FIG. 1, the torque system controls the torque output mode and the torque of a spindle 80. The torque system includes a first body 10, a second body 20, a toothed ring 30, a plurality of control pins 40, a mode selecting assembly 50, a torque adjusting module 60 and a gear set 70. The mode selecting assembly 50 includes a braking piece 51 disposed in an adjusting ring 52. The torque adjusting module 60 is composed of a thrust ring 61, a torque spring 62, a washer 63, a plurality of pins 64 and an adjusting frame 65. The torque spring 62 is combined with the thrust ring 61. The washer 63 is disposed at one end of the torque spring 62. The pins 64 are disposed on one side of the washer 63.

Figure 2:
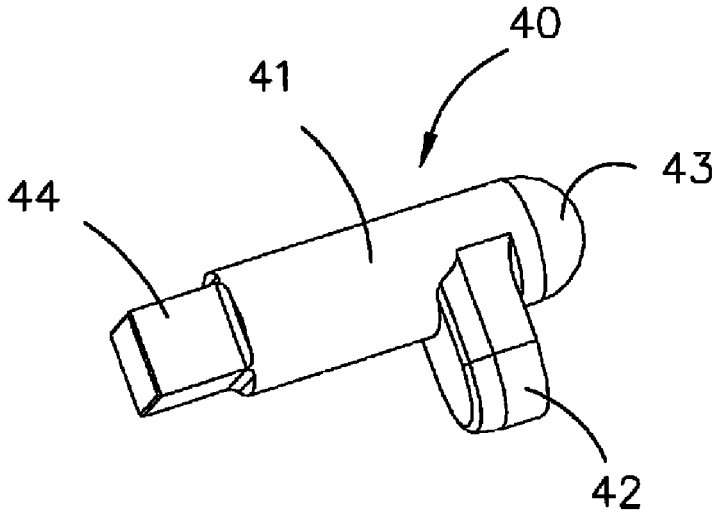
FIG. 2 is an exterior view showing a control pin of the invention.

Referring to FIG. 2, the control pin 40 includes a rod body 41, and a stopper block 42 extending from one side of the rod body 41. The rod body 41 has one end formed with an arced portion 43, and the other end formed with a polygonal portion 44.

Figure 3:
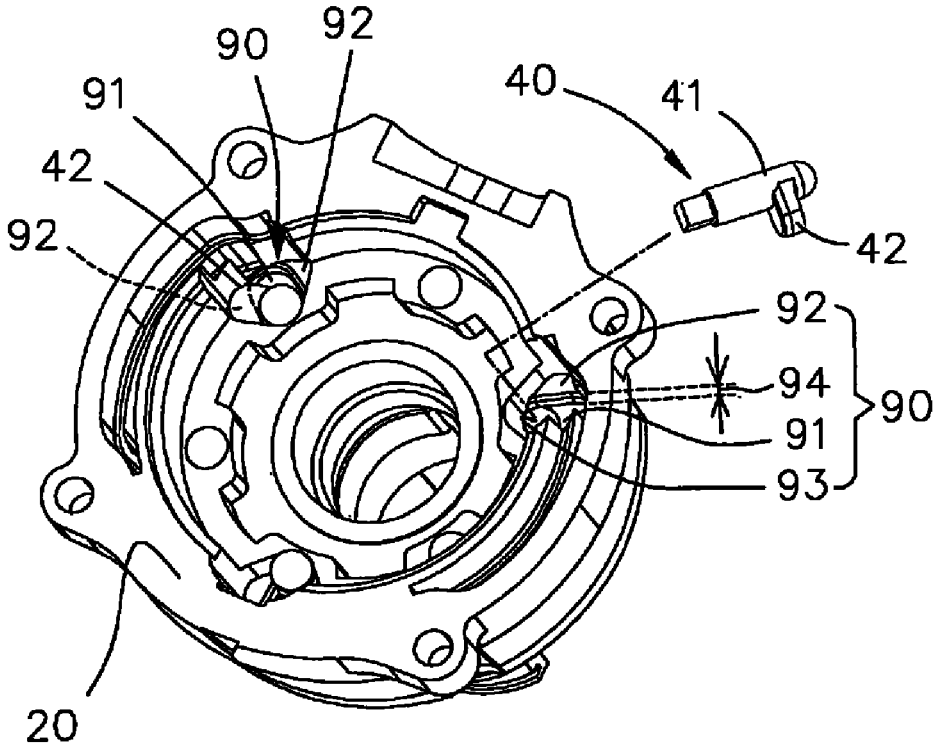
FIG. 3 is an assembled exterior view showing a second body and the control pin of the invention.
Figure 4:
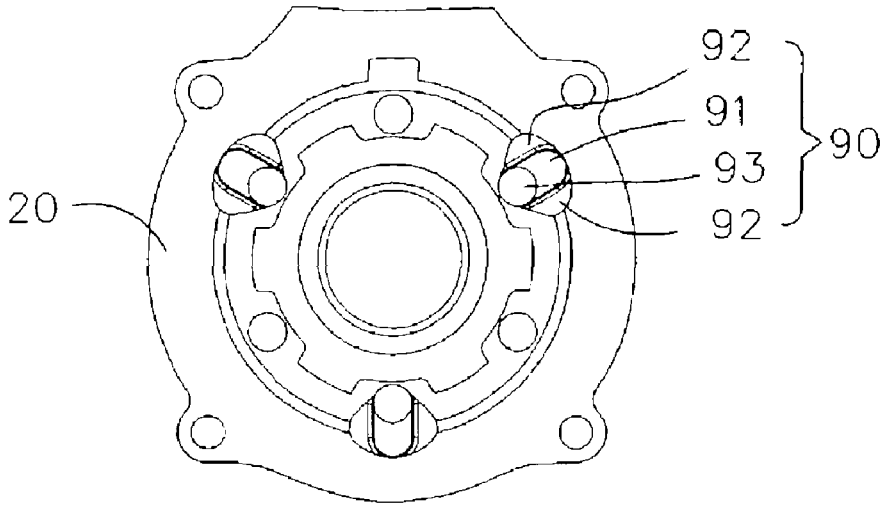
FIG. 4 is a schematically assembled view showing the second body and the control pin of the invention.

As shown in FIGS. 3 and 4, restricting mechanisms 90 are formed in the second body 20. Each restricting mechanism 90 has a first stopper 91, a second stopper 92 and a through hole 93. The second stopper 92 is disposed on a periphery of the first stopper 91, and the first stopper 91 and the second stopper 92 are disposed on different planes. So, the first stopper 91 and the second stopper 92 constitute a slot-like structure, and a step 94 (see FIG. 3) is formed between the first stopper 91 and the second stopper 92. The through hole 93 is disposed at one end of the first stopper 91 and penetrates through the second body 20.

FIG. 3 shows that the control pin 40 is disposed within the restricting mechanism 90. More particularly, the rod body 41 is inserted into the through hole 93, and the stopper block 42 corresponds to the second stopper 92 or the first stopper 91.

Figure 5:
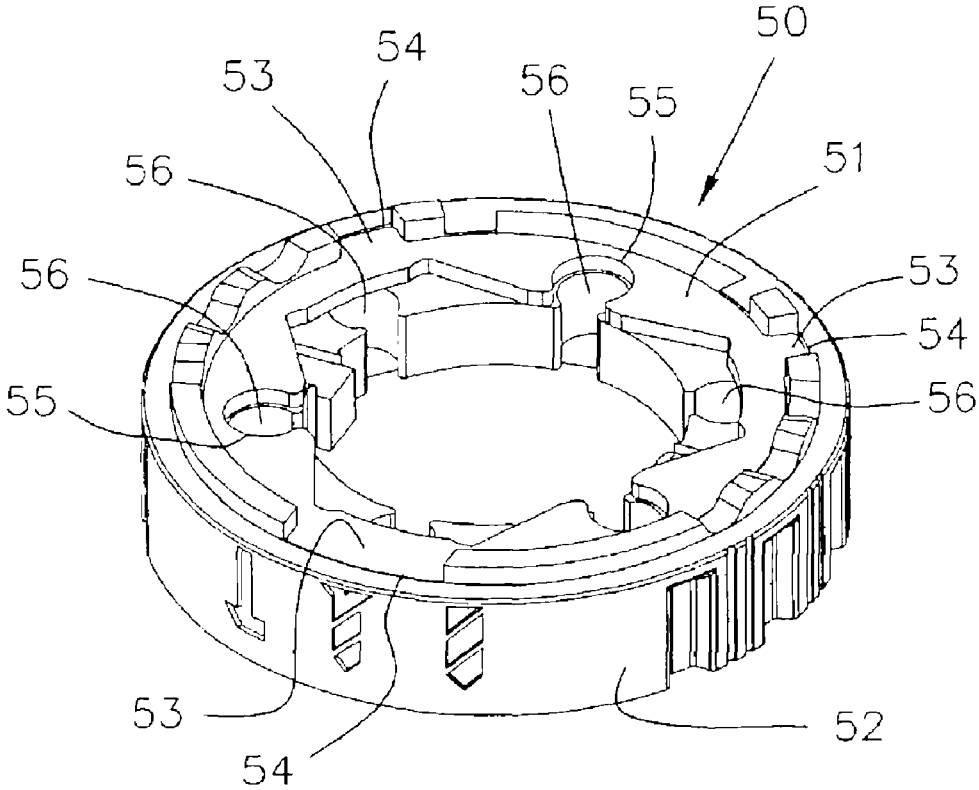
FIG. 5 is an assembled view showing a mode selecting assembly of the invention.

As shown in FIG. 5, the periphery of the braking piece 51 of the mode selecting assembly 50 is formed with a plurality of wing portions 53. Each wing portion 53 is embedded into an embedding cavity 54 on an inner wall of the adjusting ring 52 so that the braking piece 51 is combined with the adjusting ring 52. The braking piece 51 has a plurality of first pin holes 55. The adjusting ring 52 has a plurality of second pin holes 56. The number of the first pin holes 55 may be smaller than the number of the second pin holes 56, and the first pin holes 55 may respectively correspond to the second pin holes 56.

Figure 6:
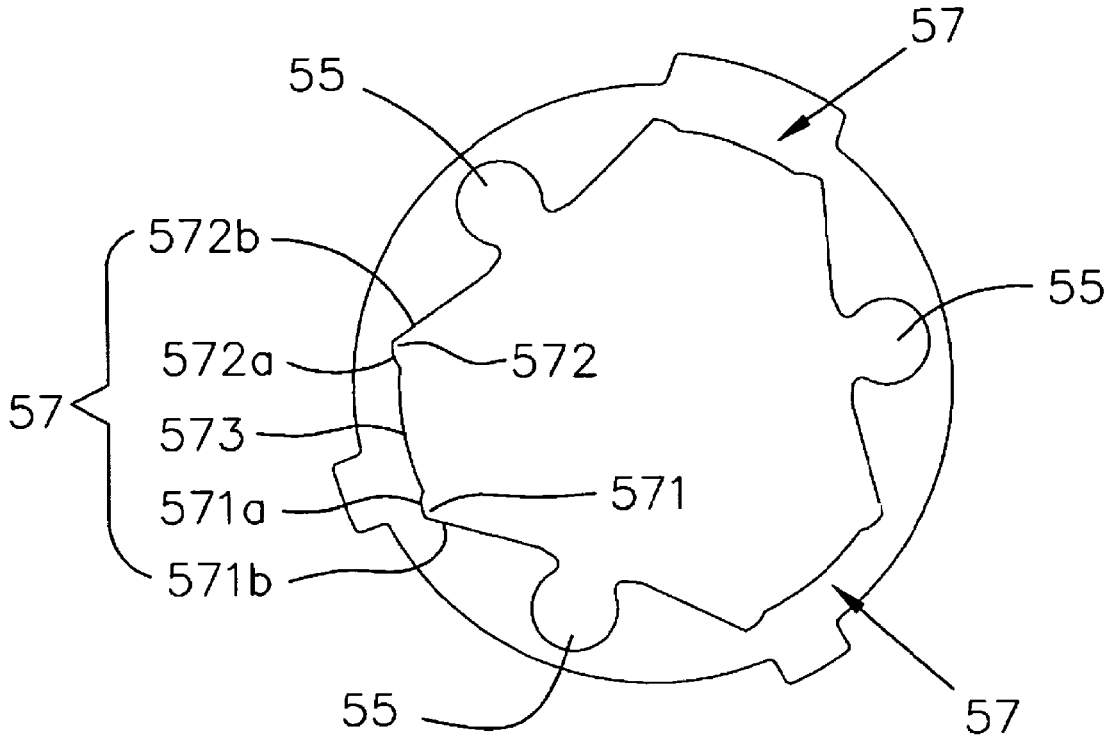
FIG. 6 is a schematic illustration showing a structure of a braking piece of the invention.

As shown in FIG. 6, a plurality of braking mechanisms 57 is formed on the braking piece 51. More specifically, each braking mechanism 57 is disposed between two neighboring first pin holes 55. The braking mechanism 57 includes a first braking concavity 571 and a second braking concavity 572, and a connection edge 573 connects the first braking concavity 571 to the second braking concavity 572.

In detail, the first braking concavity 571 has a first edge 571*a* and a second edge 571*b*; the second braking concavity 572 has a third edge 572*a* and a fourth edge 572*b*; the first edge 571*a* and the third edge 572*a* may be arced edges; and two ends of the connection edge 573 are connected to the first edge 571*a* and the third edge 572*a*.

Figure 7:
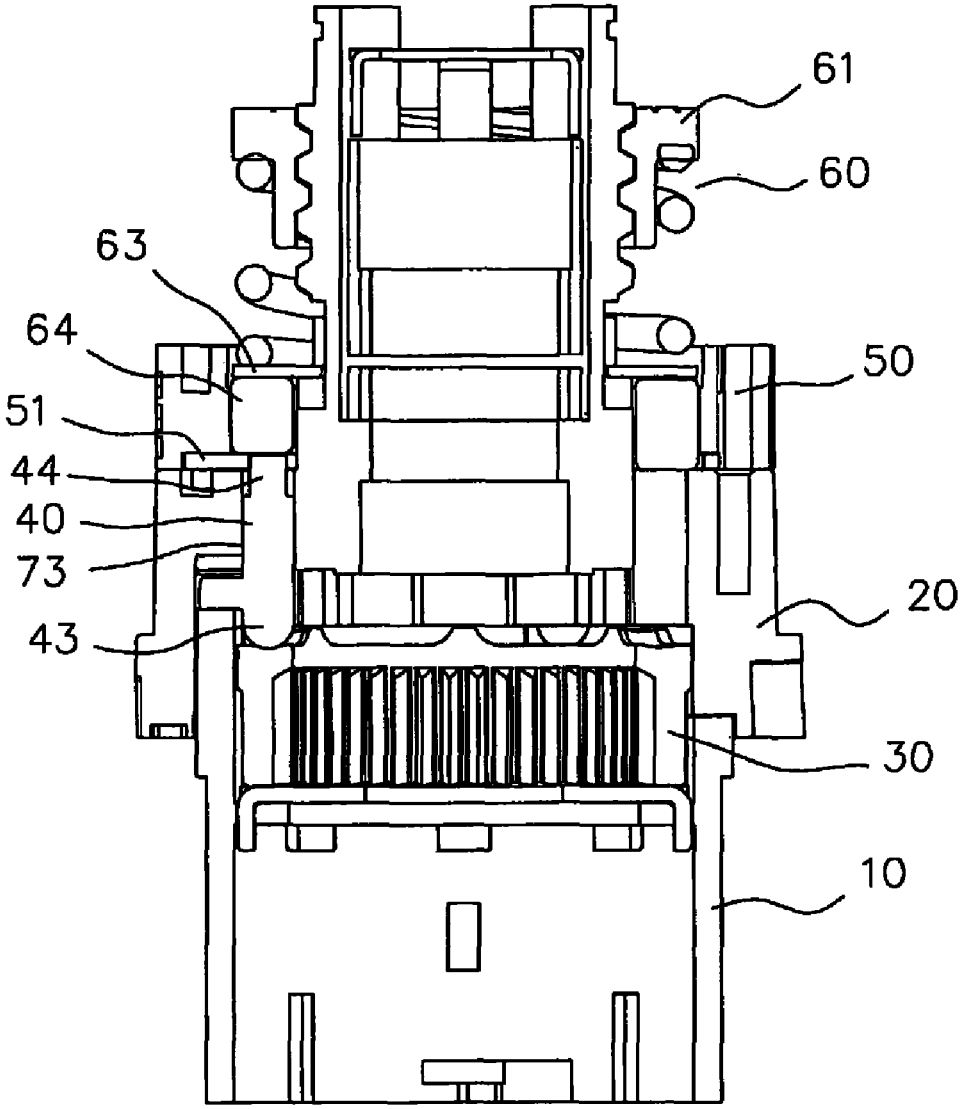
FIG. 7 is a schematically assembled view showing the invention.

As shown in FIG. 7, the first body 10 is combined with the second body 20, and the internal toothed ring 30 may be disposed between the first body 10 and the second body 20. Each control pin 40 is movably disposed in the second body 20 and has one end facing the toothed ring 30. The mode selecting assembly 50 is disposed on the second body 20 to be in contact with one end of each control pin 40. The torque adjusting module 60 is disposed on the second body 20.

More specifically, the polygonal portion 44 of the control pin 40 penetrates through a through hole 73 to be in contact with the braking mechanism of the braking piece 51. The arced portion 43 of the control pin 40 faces the toothed ring 30, or the arced portion 43 presses against the toothed ring 30.

A pin 64 of the torque adjusting module 60 is disposed in the second pin hole 56 of the adjusting ring 52. The washer 63 presses one end of each pin 64, and the torque spring 62 presses the washer 63. When the pin 64 faces the control pin 40 and the control pin 40 is movable, adjusting the position of the thrust ring 61 can change the compression amount of the torque spring 62 so that the force of the pin 64 of pressing the control pin 40 is changed.

Figure 8B:
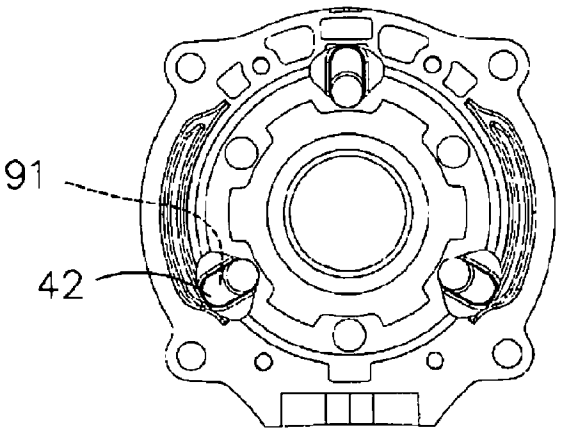
FIG. 8*b* is a second schematic illustration showing the configuration in the screw operation mode of the invention.
Figure 8A:
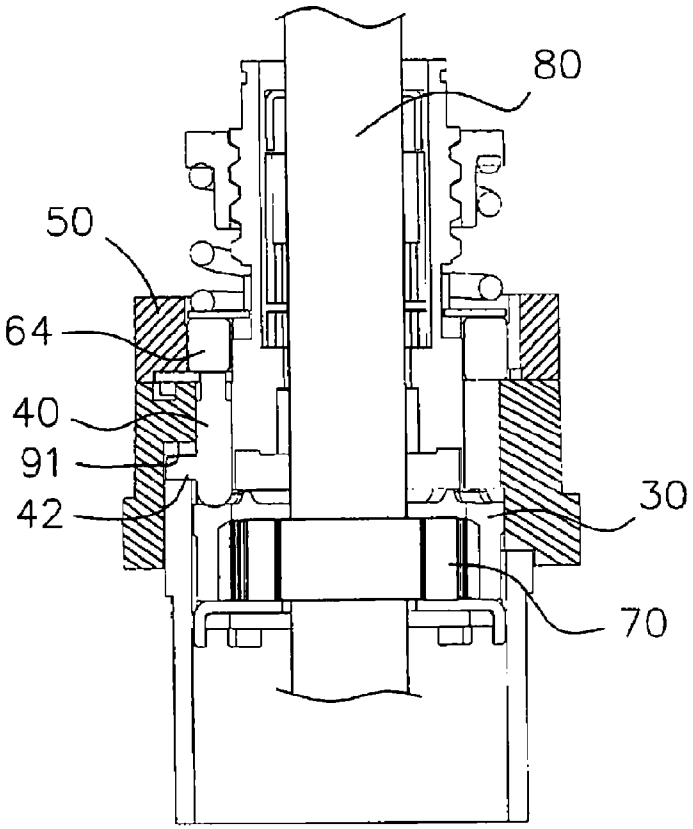
FIG. 8*a* is a first schematic illustration showing the configuration in the screw operation mode of the invention.

As shown in FIG. 8*a*, the mode selecting assembly 50 is rotated to correspond to the screw mode. At this time, the pin 64 rests on the control pin 40 to provide the pressure corresponding to the predetermined torque. FIGS. 8*a* and 8*b* show that the stopper block 42 faces the first stopper 91. FIG. 8*c* shows that the polygonal portion 44 neighbors upon the connection edge 573.

Referring again to FIG. 8*a*, the torque outputted by the rotation of the gear set 70 may be applied to the toothed ring 30 and the spindle 80. Because the toothed ring 30 is pressed by the control pin 40, the output torque of the gear set 70 can drive the spindle 80 to rotate when the output torque of the gear set 70 is insufficient to drive the toothed ring 30. As the work proceeds, the resisting force at the output end of the spindle 80 gradually increases.

Figure 8D:
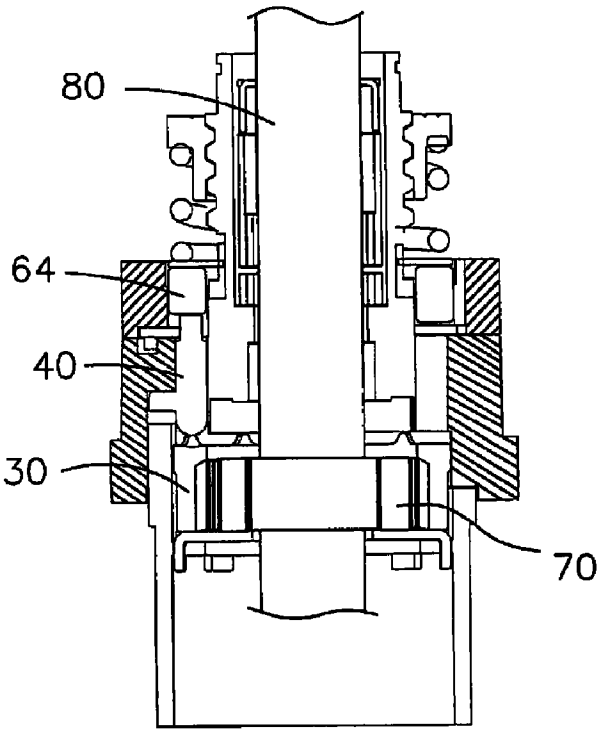
FIG. 8*d* is a schematic illustration showing a gear jumping operation in the screw operation mode of the invention.
Figure 8C:
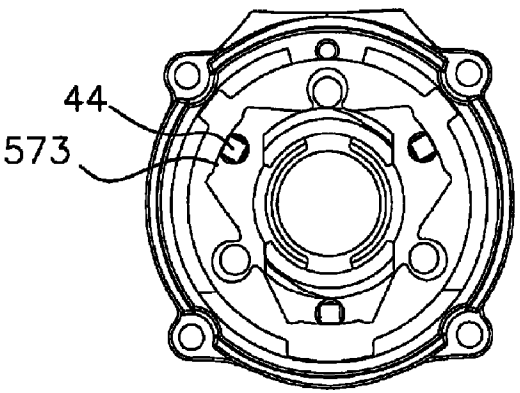
FIG. 8*c* is a third schematic illustration showing the configuration in the screw operation mode of the invention.

As shown in FIG. 8*d*, when the output torque of the gear set 70 is smaller than the resisting force at the output end of the spindle 80 and is sufficient to drive the toothed ring 30, then the output torque of the gear set 70, corresponding to the resisting force at the output end of the spindle, drives the toothed ring 30 to rotate and push the control pin 40 and the pin 64 to shift (jump).

Figure 9B:
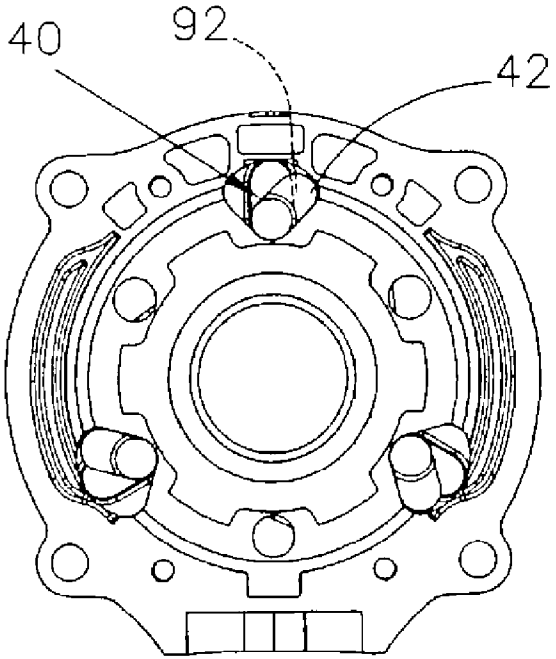
FIG. 9*b* is a second schematic illustration showing the configuration in the drill operation mode of the invention.
Figure 9A:
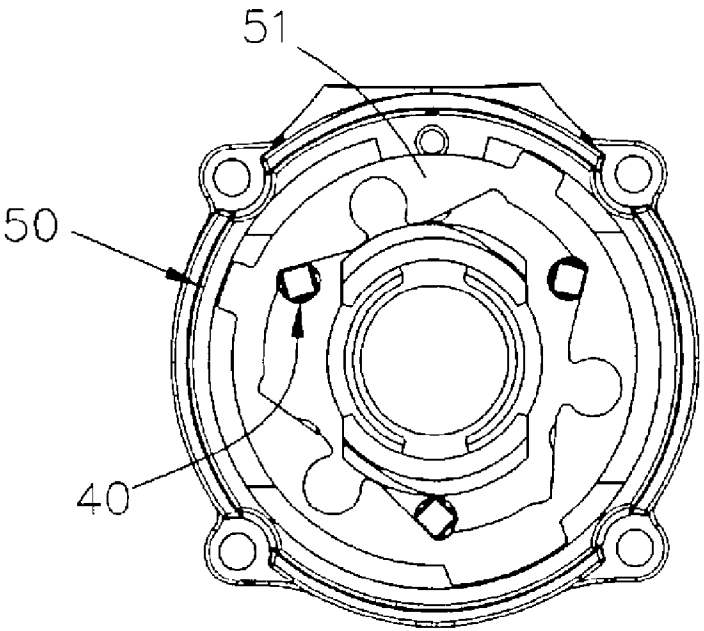
FIG. 9*a* is a first schematic illustration showing the configuration in the drill operation mode of the invention.

As shown in FIG. 9*a*, the mode selecting assembly 50 is rotated such that it corresponds to the drill mode. At this time, the control pin 40 is driven by the braking piece 51 to rotate itself by an angle. As shown in FIG. 9*b*, the control pin 40 rotates itself to make the stopper block 42 face the second stopper 92 in the drill mode.

Figure 9C:
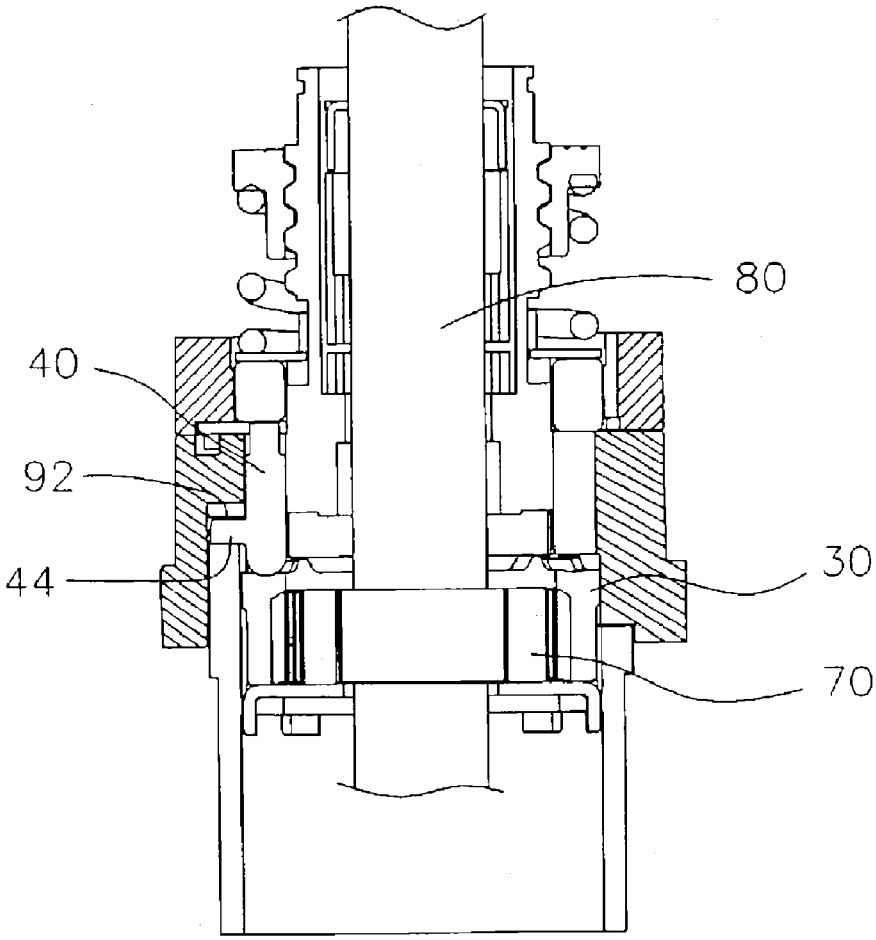
FIG. 9*c* is a third schematic illustration showing the configuration in the drill operation mode of the invention.

According to the transmission mode of the torque, as shown in FIG. 9*c* in the drill mode, the stopper block 42 faces the second stopper 92. So, the control pin 40 cannot shift, and the toothed ring 30 cannot drive the control pin 40 to shift (jump). Furthermore, the torque transmitted by the gear set 70 can be completely transmitted to the spindle 80.

Figure 10B:
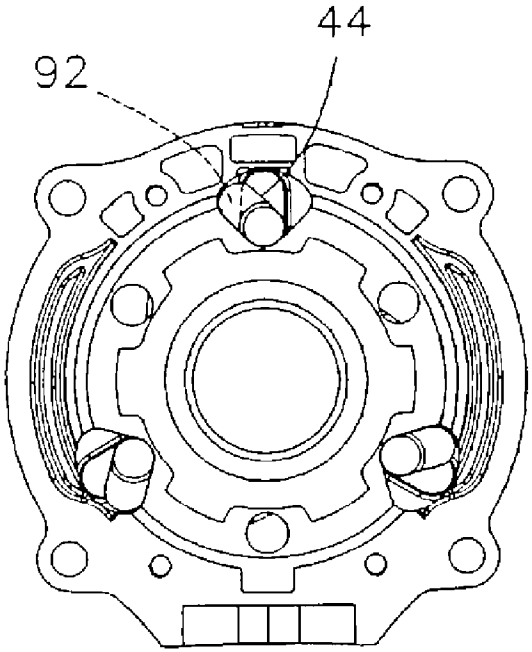
FIG. 10*b* is a schematic illustration showing a gear jumping operation in the hammer operation mode of the invention.
Figure 10A:
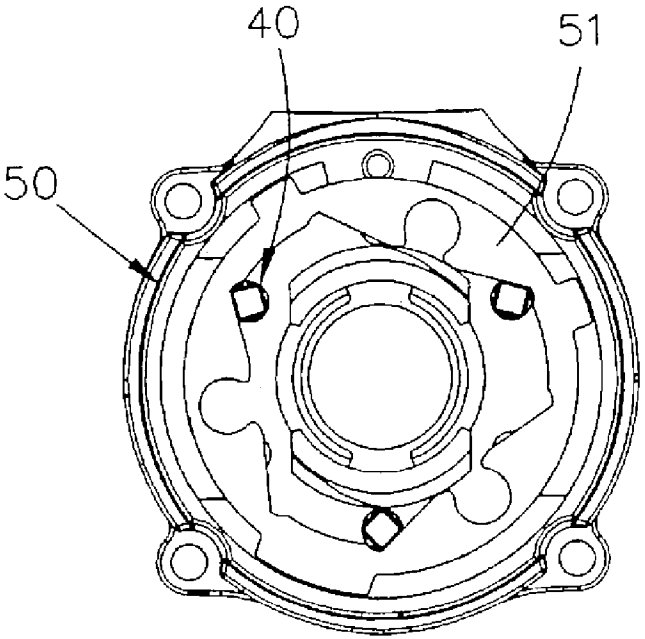
FIG. 10*a* shows the configuration in the hammer operation mode of the invention.

As shown in FIG. 10*a*, the mode selecting assembly 50 is rotated such that it corresponds to the hammer mode. At this time, the control pin 40 is driven by the braking piece 51 to rotate by an angle. As shown in FIG. 10*b*, the stopper block 42 faces the second stopper 92 in the hammer mode.

According to the teachings mentioned hereinabove, the toothed ring 30 cannot drive the control pin 40 to shift (jump) when the stopper block 42 faces the second stopper 92. In other words, the power transmission way in the hammer operation mode is the same as that in the drill operation mode.

Figure 11:
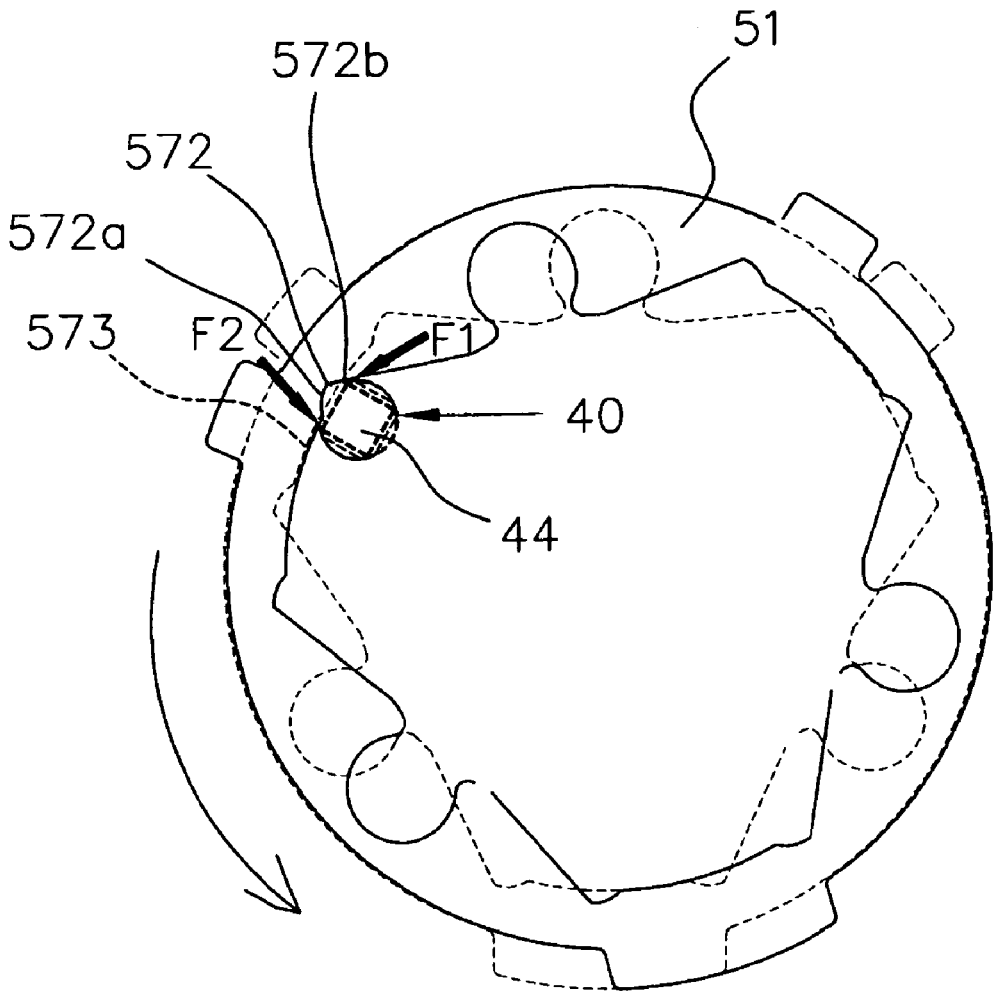
FIG. 11 is a schematic illustration showing the operation of the braking piece which drives the control pin according to the invention.

With regard to the braking piece 51, which drives the control pin 40 to rotate, as shown in FIG. 11, the polygonal portion 44 of the control pin 40 neighbors upon the connection edge 573 (as shown by the dashed line in the drawing). When the braking piece 51 rotates counterclockwise, the polygonal portion 44 neighbors upon the second braking concavity 572, and the third edge 572*a* and the fourth edge 572*b* can be in contact with the polygonal portion 44. As the braking piece 51 continuously rotates, the third edge 572*a* and the fourth edge 572*b* may apply a couple (F1, F2) to the polygonal portion 44 such that the control pin 40 rotates itself by an angle. Similarly, the braking piece 51 is rotated clockwise, and the control pin 40 may also rotate itself by an angle.

According to the above-mentioned description, the elements constituting the torque system are fewer so that the material cost and the assembling cost can be lowered. In addition, the structures and assembling configurations of the braking piece and the control pin can make the control of the operation mode of the power tool become more precise. Moreover, when the braking piece is rotated to generate the couple to drive each control pin to rotate, each pin in the torque adjusting module cannot press the control pin. Thus, the force of switching the operation mode may be smaller than that in the conventional mechanism.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A torque system of a power tool for driving a spindle and switching a working mode, the torque system comprising:

a first body;

a second body combined with the first body and having a plurality of restricting mechanisms;

a toothed ring disposed between the first body and the second body;

a mode selecting assembly disposed on the second body;

a plurality of control pins respectively mounted on the restricting mechanisms of the second body, wherein each of the control pins has a rod body, a stopper block formed on one side of the rod body, one end facing the toothed ring, and the other end facing the mode selecting assembly;

a torque adjusting module disposed on the second body, wherein:

each of the restricting mechanisms comprises a through hole, a first stopper and a second stopper, the through hole penetrates through the first stopper; the second stopper is disposed on a periphery of the first stopper, and one step is formed between the first stopper and the second stopper; and the rod body of the control pin is inserted into the through hole, and the stopper block faces the first stopper or the through hole.

2. The torque system according to claim 1, wherein the mode selecting assembly comprises a braking piece disposed in an adjusting ring, and the braking piece is in contact with the control pin.

3. The torque system according to claim 2, wherein the braking piece has a plurality of first pin holes, the adjusting ring has a plurality of second pin holes, and the number of the first pin holes is smaller than the number of the second pin holes.

4. The torque system according to claim 3, wherein the braking piece has a plurality of braking mechanisms respectively disposed between neighboring two of the first pin holes and in contact with the control pins.

5. The torque system according to claim 4, wherein each of the braking mechanism comprises a first braking concavity, a second braking concavity, and a connection edge connecting the first braking concavity to the second braking concavity.

6. The torque system according to claim 5, wherein first braking concavity has an arced first edge, the second braking concavity has an arced third edge, and the connection edge connects the first edge to the third edge.

7. torque system according to claim 1, wherein the torque adjusting module comprises a thrust ring, a torque spring, a washer and a plurality of pins, the torque spring is combined with the thrust ring, the washer is disposed at one end of the torque spring, and the pins are disposed on one side of the washer and face the mode selecting assembly.

8. The torque system according to claim 7, wherein the mode selecting assembly has an adjusting ring, and the adjusting ring has a plurality of second pin holes, in which multiple pins are respectively disposed.

9. A torque system of a power tool for driving a spindle and switching a working mode, the torque system comprising:

a first body;

a second body combined with the first body and having a plurality of restricting mechanisms;

a toothed ring disposed between the first body and the second body;

a mode selecting assembly disposed on the second body;

a plurality of control pins respectively mounted on the restricting mechanisms of the second body, wherein each of the control pins has a rod body, and the rod body has one end formed with an arced portion, the other end formed with a polygonal portion, and one side formed with a stopper block;

a torque adjusting module disposed on the second body, wherein:

each of the restricting mechanisms comprises a through hole, a first stopper and a second stopper, the through hole penetrates through the first stopper; the second stopper is disposed on a periphery of the first stopper, and a step is formed between the first stopper and the second stopper; and the rod body of the control pin is inserted into the through hole, the stopper block faces the first stopper or the through hole, the arced portion faces the toothed ring, and the polygonal portion is in contact with the mode selecting assembly.

10. The torque system according to claim 9, wherein the mode selecting assembly comprises a braking piece disposed in an adjusting ring, and the braking piece is in contact with the polygonal portion of the control pin.

11. The torque system according to claim 10, wherein the braking piece has a plurality of first pin holes, the adjusting ring has a plurality of second pin holes, and the number of the first pin holes is smaller than the number of the second pin holes.

12. The torque system according to claim 11, wherein the braking piece has a plurality of braking mechanisms, each of which is disposed between neighboring two of the first pin holes and in contact with the control pin.

13. The torque system according to claim 12, wherein each of the braking mechanism comprises a first braking concavity, a second braking concavity, and a connection edge connecting the first braking concavity to the second braking concavity.

14. The torque system according to claim 13, wherein first braking concavity has an arced first edge, the second braking concavity has an arced third edge, and the connection edge connects the first edge to the third edge.

15. The torque system according to claim 9, wherein the torque adjusting module comprises a thrust ring, a torque spring, a washer and a plurality of pins, the torque spring is combined with the thrust ring, the washer is disposed at one end of the torque spring, and the pins are disposed on one side of the washer and face the mode selecting assembly.

16. torque system according to claim 15, wherein the mode selecting assembly has an adjusting ring, and the adjusting ring has a plurality of second pin holes, in which multiple pins are respectively disposed.

* * * * *